United States Patent [19]

Handler

[11] Patent Number: 4,863,127

[45] Date of Patent: Sep. 5, 1989

[54] WALL HANGING SYSTEM FOR ARTICLES

[75] Inventor: Michael D. Handler, Norwalk, Conn.

[73] Assignee: Velcro Industries B.V., Netherlands

[21] Appl. No.: 248,246

[22] Filed: Sep. 19, 1988

Related U.S. Application Data

[63] Continuation of Ser. No. 893,388, Aug. 5, 1986, abandoned.

[51] Int. Cl.[4] ..... A47G 29/00

[52] U.S. Cl. ..... 248/205.2; 248/250; 248/683

[58] Field of Search ..... 248/205.2, 250, 359 A; 52/DIG. 13

[56] References Cited

U.S. PATENT DOCUMENTS

| | | | |
|---|---|---|---|
| 680,047 | 8/1901 | King | 24/64 |
| 1,638,073 | 8/1927 | Van Heusen | 24/204 |
| 1,770,836 | 7/1930 | Boote | 312/330 R |
| 2,728,480 | 12/1955 | Close | 312/263 |
| 3,067,903 | 12/1962 | Jones, Jr. | 220/221 |
| 3,101,517 | 8/1963 | Fox et al. | 24/442 |
| 3,176,364 | 4/1965 | Dritz | 24/204 |
| 3,192,306 | 6/1965 | Skonnord | 312/213 |
| 3,251,399 | 5/1966 | Grossman | 160/180 |
| 3,338,291 | 8/1967 | Kintner | 24/306 |
| 3,370,818 | 2/1968 | Perr | 248/205.2 |
| 3,413,656 | 12/1968 | Vogliano et al. | 2/2 |
| 3,455,589 | 7/1969 | Valiulis | 24/442 |
| 3,460,860 | 8/1969 | Stevens | 52/71 |
| 3,475,810 | 11/1969 | Mates | 24/204 |
| 3,491,486 | 1/1970 | Caruth | 49/463 |
| 3,491,909 | 1/1970 | Ikelheimer | 220/22 |
| 3,499,695 | 3/1970 | Studinski | 312/330 R X |
| 3,512,318 | 5/1970 | Turner | 52/100 |
| 3,566,556 | 3/1971 | Nichols | 52/71 |
| 3,668,808 | 6/1972 | Perina | 49/465 |
| 3,680,177 | 8/1972 | Ginsberg | 312/330 R |
| 3,696,472 | 10/1972 | Perina et al. | 24/205 |
| 3,721,050 | 3/1973 | Perina | 52/DIG. 13 |
| 3,742,644 | 7/1973 | Williams | 24/442 |

(List continued on next page.)

FOREIGN PATENT DOCUMENTS

| | | | |
|---|---|---|---|
| 2612773 | 10/1976 | Fed. Rep. of Germany . | |
| 2002720 | 2/1979 | Fed. Rep. of Germany | 312/330 R |
| 8626321 | 11/1986 | Fed. Rep. of Germany . | |
| 2167922 | 6/1973 | France . | |
| 248783 | 2/1948 | Switzerland | 24/557 |
| 452477 | 5/1958 | Switzerland | 24/442 |

*Primary Examiner*—Alvin C. Chin-Shue

*Attorney, Agent, or Firm*—Hayes, Soloway, Hennessey & Hage

[57] ABSTRACT

A wall hanging system of the shear trap channel hook and loop fastening system type having a hooked surface portion and a looped surface portion adapted for releasably fastening shelves and other like components to a wall or the like in shear by means of a trap channel member having parallel inner faces each having one of the portions thereon and adapted to releasably receive a planar member with the other portion on its outer surfaces between the trap channel member's inner faces with the respective portions in engagement. The wall hanging system is characterized by mounting means carrying the trap channel member and adapted for mounting to a wall or the like; and, attachment means carried by the component to be releasably mounted to the wall including a planar member extending therefrom for engagement with the trap channel member. In one embodiment, the attachment means comprises a vertical fin extending normal to the back surface of the component at the point of intended mounting to a vertically disposed trap channel member. In another embodiment, the attachment means comprises a vertical fin extending upward parallel to the back surface of the component at the point of intended mounting to a horizontally disposed trap channel member. The shear trap member is preferably a resiliently rigid plastic channel having a back portion and two parallel facing side portions wherein the mounting means comprises a plurality of holes in the back portion for receiving mounting devices such as screws, nails, and bolts therethrough.

14 Claims, 15 Drawing Sheets

U.S. PATENT DOCUMENTS

| | | | |
|---|---|---|---|
| 3,745,709 | 7/1973 | Perina | 49/465 |
| 3,777,435 | 12/1973 | Perina | 52/DIG. 13 |
| 3,780,479 | 12/1973 | Billarant | 52/DIG. 13 |
| 3,854,239 | 12/1974 | Williams | 24/442 |
| 3,892,451 | 7/1975 | Bruins | 312/330 R |
| 3,940,873 | 3/1976 | Lawless | 24/442 |
| 4,028,855 | 6/1977 | Prewer | 52/DIG. 13 |
| 4,098,402 | 7/1978 | Rogg . | |
| 4,163,303 | 8/1979 | Perina | 24/204 |
| 4,165,555 | 8/1979 | Boxer et al. | 24/204 |
| 4,271,566 | 6/1981 | Perina | 24/294 |
| 4,273,130 | 6/1981 | Simpson | 24/306 |
| 4,275,520 | 6/1981 | Appleton | 52/DIG. 13 |
| 4,308,642 | 1/1982 | Heyman | 24/306 |
| 4,352,524 | 10/1982 | Crosby | 24/442 X |
| 4,361,099 | 11/1982 | Kokenge et al. | 248/250 |
| 4,416,038 | 11/1983 | Morrone, III | 24/487 |
| 4,493,174 | 1/1985 | Arens | 52/243 |
| 4,518,191 | 5/1985 | Williams et al. | 248/223.4 |
| 4,524,992 | 6/1985 | Linn | 24/487 |
| 4,534,471 | 8/1985 | Zahn et al. | 211/39 |
| 4,548,375 | 10/1985 | Moss | 248/205.2 |

WALL HANGING SYSTEM FOR ARTICLES

This is a continuation of co-pending application Ser. No. 893,388, filed on Aug. 5, 1986, now abandoned.

BACKGROUND OF THE INVENTION

The present invention relates to wall hanging systems for removably attaching shelves, and the like, to walls and other planar surfaces, and more particularly, to a wall hanging system of the shear trap channel hook and loop fastening system type having a hooked surface portion and a looped surface portion adapted for releasably fastening shelves and other like components to a wall or the like having shear by means of a trap channel member having parallel inner faces each having one of the portions thereon and adapted to releasably receive a planar member with the other portion on its outer surfaces between the trap channel member's inner faces with the respective portions in engagement; wherein, the wall hanging system is characterized by mounting means carrying the trap channel member and adapted for mounting to a wall or the like; and, attachment means carried by the component to be releasably mounted to the wall including the planar member extending therefrom for engagement with the trap channel member; and wherein, the attachment means may comprise a vertical fin extending normal to the back surface of the component at the point of intended mounting to a vertically disposed trap channel member or may comprise a vertical fin extending upward parallel to the back surface of the component at the point of intended mounting to a horizontally disposed trap channel member.

Wall hanging systems for releasably attaching shelves and the like, to walls and other planar surfaces are known in the art. Due to the stresses and forces involved, in order to be releasable, the components of the fastening systems used therewith are typically totally of metal or, at the very least, employ metal components at the points of the stresses and forces. Probably the best known and most used design employs steel U-shaped channels that are attached to the wall or panel with the opening of the U thereagainst. The brackets for the shelves (or other components to be mounted thereon) have ears that are wedgedly fit into slots provided therefor in the back of the channels.

Wherefore, it is the object of the present invention to provide a wall hanging system for attaching shelves and other articles to walls, and the like that can be manufactured of light weight materials such as plastic, while, at the same time, are able to withstand the stresses and forces involved while being easily attachable and releasable.

SUMMARY

The foregoing object has been achieved by the wall hanging system of the present invention which employs a shear trap channel hook and loop fastening system of the type having a hooked surface portion and a looped surface portion adapted for releasably fastening shelves and other like components to a wall or the like in shear by means of a trap channel member having parallel inner faces each having one of the portions thereon adapted to releasably receive a planar member with the other portion on its outer surfaces between the trap channel member's inner faces with the respective portions in engagement. The wall hanging system is characterized by mounting means carrying the trap channel member and adapted for mounting to a wall or the like; and, attachment means carried by the component to be releasably mounted to the wall including a planar member extending therefrom for engagement with the trap channel member. In one embodiment, the attachment means comprises a vertical fin extending normal to the back surface of the component at the point of intended mounting to a vertically disposed trap channel member. In another embodiment, the attachment means comprises a vertical fin extending upward parallel to the back surface of the component at the point of intended mounting to a horizontally disposed trap channel member. The shear trap member is preferably a resiliently rigid plastic channel having a back portion and two parallel facing side portions wherein the mounting means comprises a plurality of holes in the back portion for receiving mounting devices such as screws, nails, and bolts therethrough.

DESCRIPTION OF THE PREFERRED EMBODIMENT

In my co-pending patent application entitled SHEAR TRAP HOOK AND LOOP FASTENING SYSTEM, filed on even date herewith and assigned to the common assignee of this application, I described an improvement to hook and loop fastening systems wherein a shear trap channel is employed to use the hook and loop fastening material "in shear" to provide a high holding strength. The shear trap channel, however, allows the hook and loop fastening materials to be disengaged easily when necessary. The teachings of that co-pending application are hereby incorporated herein by reference and, accordingly, only a cursory description of the basic invention as incorporated into this invention will be provided.

Figure 1:
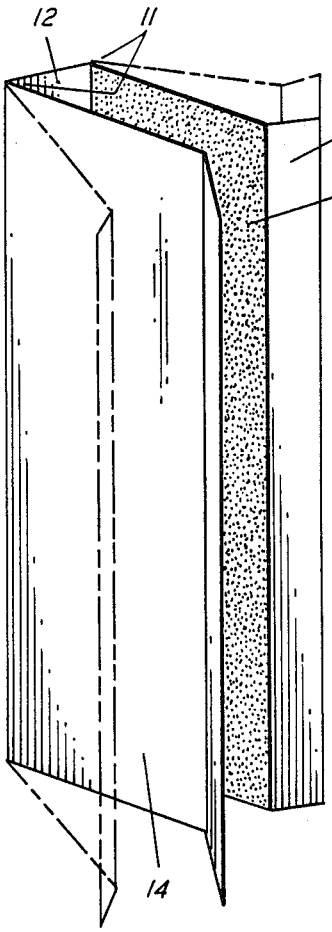
FIG. 1 is a simplified perspective view of one embodiment of applicant's invention of a shear trap channel as employed in the present invention.
Figure 2:
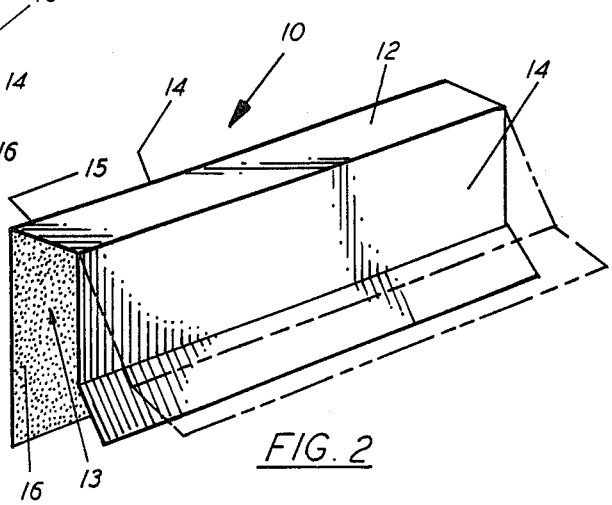
FIG. 2 is a simplified perspective view of a second embodiment of applicant's invention of a shear trap channel as employed in the present invention.

Turning briefly to FIGS. 1 and 2, the shear trap channels are shown in simplified form. In both cases, the shear trap channel is indicated as 10 and comprises a back portion 12 from which two parallel, spaced side portions 14 extend. In the preferred embodiment, the trap channels 10 are made of a resiliently rigid plastic and hinges 11 between sides and back are so-called "living hinges" formed into the plastic material. In the embodiment of FIG. 1, both side portions 14 are hingedly attached by hinges 11 to the back portion 12 such that both can swing outward, as indicated by the dotted ghost lines, for progressive release of the hook and loop fastening materials employed therewith. Attachment of something to be fastened therewith is made to the back portion. In the embodiment of FIG. 2, only the one side portion 14 is hingedly attached (by hinge 11) to the back, to permit that side portion to swing as indicated by the single dotted ghost line. Attachment to this embodiment is made to either the back portion 12 or the other side portion 14. In the preferred embodiment, the facing inner surfaces of the side portions 14 have the hook portion 16 of hook and loop type fastening material thereon. The living hinges are indicated in both cases as 11. Thus if a planar member (not shown) having the loop material on outward facing parallel surfaces is inserted between the side portions 14, the planar member will be maintained therein with the hook and loop material operating "in shear". By swinging the side portions 14 outward, however, the hook and loop materials can be progressively released to allow the planar member to be withdrawn.

In the wall fastening system of the present invention, the shear trap channels of FIG. 1 and/or FIG. 2 include means for mounting them to a wall or other surface and are employed with families of components to be described hereinafter, depending on whether vertical or horizontal mounting is desired. The mounting means may comprise a plurality of holes as at 13 in the back portion 12 for receiving mounting devices such as screws, nails, and bolts therethrough or adhesive of the peel and stick variety on the outside of the back portion 12 as at 15.

The two families of components and their points of commonality will now be described individually. The family of components related to the trap channel 10 of FIG. 1 and vertical orientation will be described first.

Figure 3:
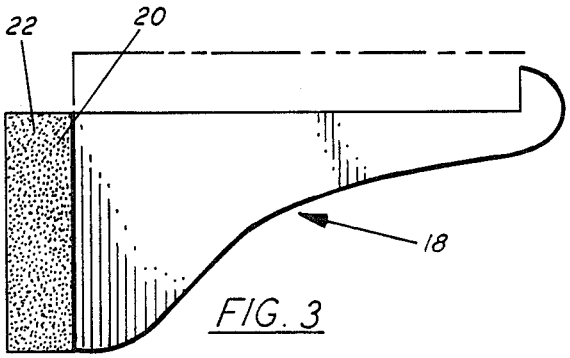
FIG. 3 is a side view of a shelf bracket according to the present invention.

The simplest example is that of FIG. 3 wherein a common shelf bracket 18 is shown of a design well known in the art and referred to under Background of the Invention as normally being manufactured of metal and incorporating fastening ears. As shown in FIG. 3, however, the bracket 18 has been adapted for use in the manner of the present invention with the shear trap channel 10 of FIG. 1. Extending outward from the bracket 18 is a vertical fin 20 having the loop portion 22 of hook and loop fastening material, such as that sold by the assignee of the present invention under the trademark Velcro, attached to the opposed outward facing surfaces thereof as with adhesive (not shown). Since the bracket 18 is a planar member, the fin 20 can be a mere extension of the bracket 18 itself. For that reason, it is the simplest example as mentioned above. For ease of manufacture, it may be simpler to take an adhesive-backed strip of the loop surfaced Velcro material and simply wrap it around the edge of the fin, thus covering the end as well as the two opposed sides, rather than attempting to put individual strips on the two individual sides.

Figure 4:
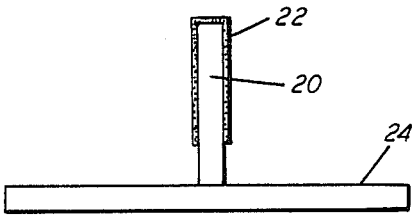
FIG. 4 is a simplified top view of a component having a planar back surface and the construction of the mounting member used therewith according to the present invention for attachment to a vertically disposed trap channel.
Figure 5:
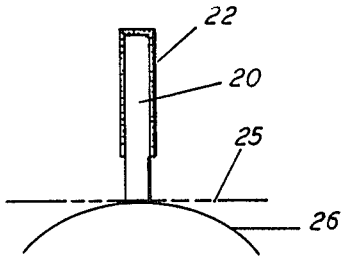
FIG. 5 is a simplified top view of a component having a non-planar back surface and the construction of the mounting member used therewith according to the present invention for attachment to a vertically disposed trap channel.
Figure 6:
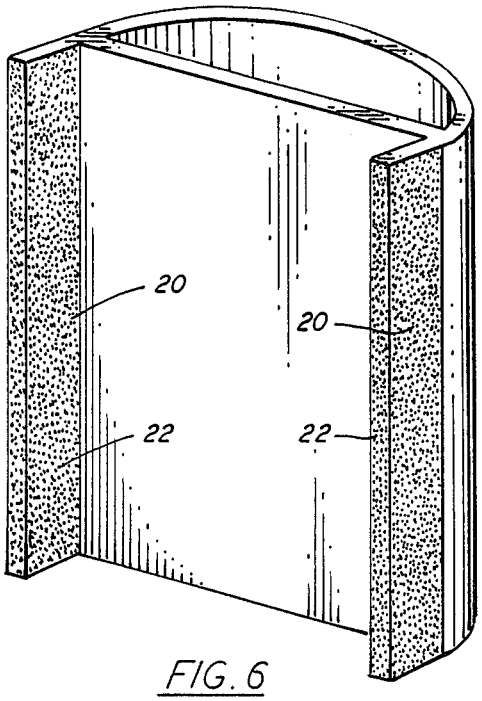
FIGS. 6–10 are perspective views of examples of components which are within a family of components according to the present invention which are constructed in accordance with the simplified examples of FIGS. 4 and 5.
Figure 7:
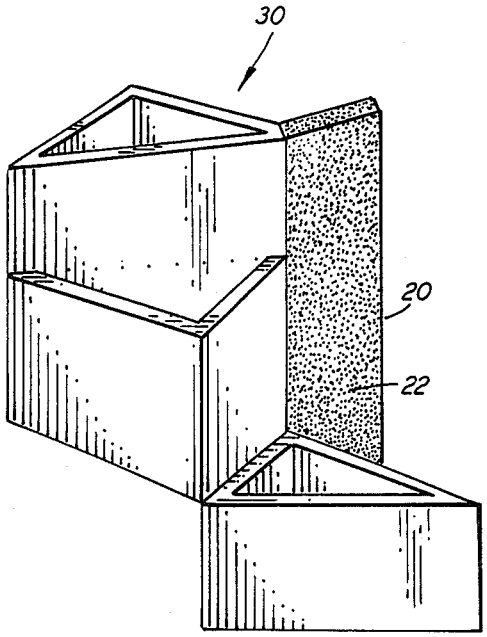
Figure 8:
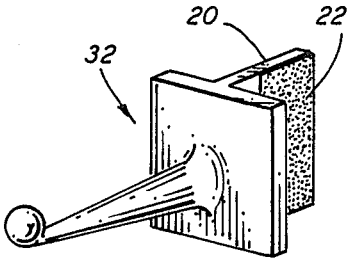
Figure 9:
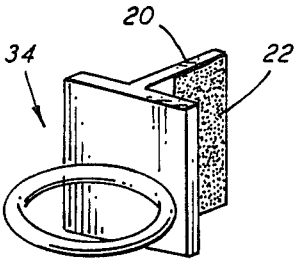
Figure 10:
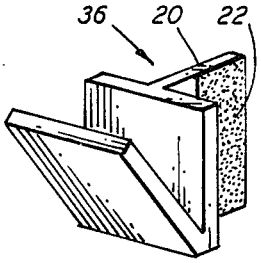
Figure 11:
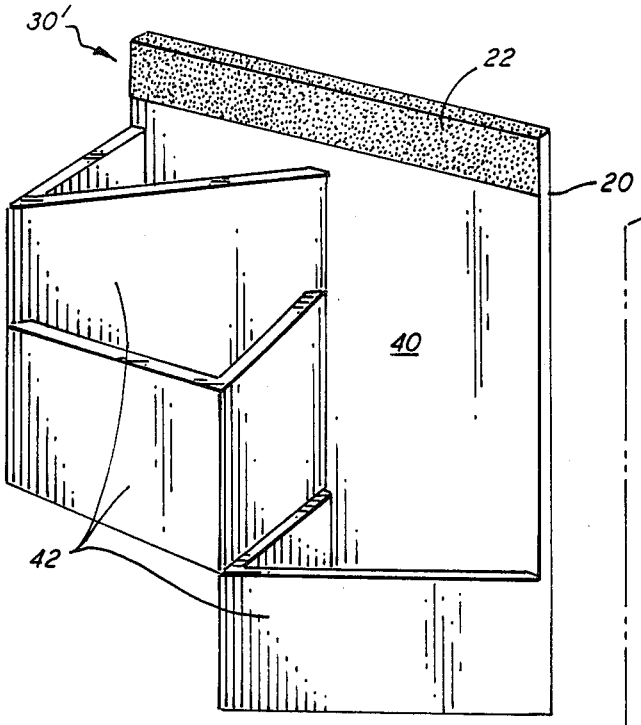
FIG. 11 is a perspective view of a storage container according to the present invention.

The point of commonality of this family of components is shown in simplified top view in FIGS. 4 and 5. In FIG. 4, the component to be mounted in the vertically disposed trap channel 10 has a planar rear surface 24. The planar mounting fin 20 is disposed vertically and perpendicular to the rear surface 24. Where the component has a non-planar rear surface 26 in the manner of FIG. 5, the planar mounting fin 20 is disposed vertically and perpendicular to a plane 25 tangent to the rear surface 26. FIGS. 6–10 show various components that could be used in an office environment according to this general family of components for vertical mounting. In particular, FIG. 6 shows the back side of a waste recepticle or file folder holder 28. FIG. 7 shows a nest 30 of small containers for pencils, paper clips and the like. FIGS. 8–10 show a coat hanger 32, ring 34 (for a screwdriver, or such), and a hook 36, respectively.

Figure 12:
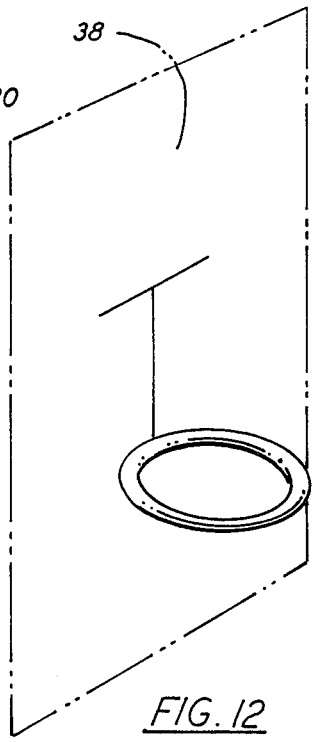
FIG. 12 is a simplified perspective view of a component having a non-planar back surface and the construction of the mounting member used therewith according to the present invention for attachment to a horizontally disposed trap channel.
Figure 13:
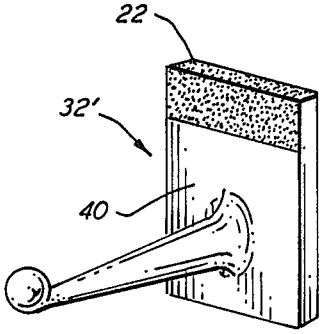
FIGS. 13–15 are perspective views of examples of components which are within a family of components according to the present invention which are constructed in accordance with the simplified examples of FIG. 12.
Figure 14:
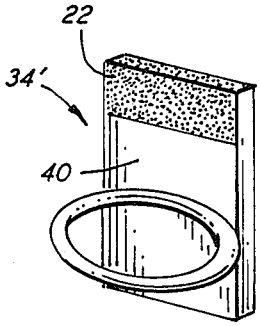
Figure 15:
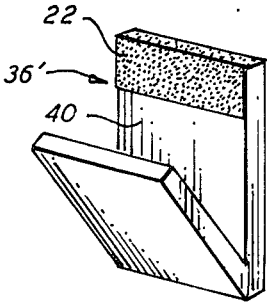

The second family of components will now be described with respect to FIGS. 11–15. The nest 30 of FIG. 7 is shown modified for attachment to a horizontally disposed trap channel 10 such as that of FIG. 2 in FIG. 11 wherein it is indicated as 30'. The principle of this family of components is shown in FIG. 12 in simplified form. As depicted therein, the fin 20 in this family is vertical but lies in a plane 38 which is parallel to or tangent to the back surface of the component to be mounted. In the case of the nest 30' the back surface 40 from which the containers 42 extend forward can merely be extended upward to form the fin 20. The same is true for the coat hanger 32', ring 34', and hook 36' of FIG. 8–10 which are shown modified for horizontal mounting in FIGS. 13–15, respectively.

Figure 16:
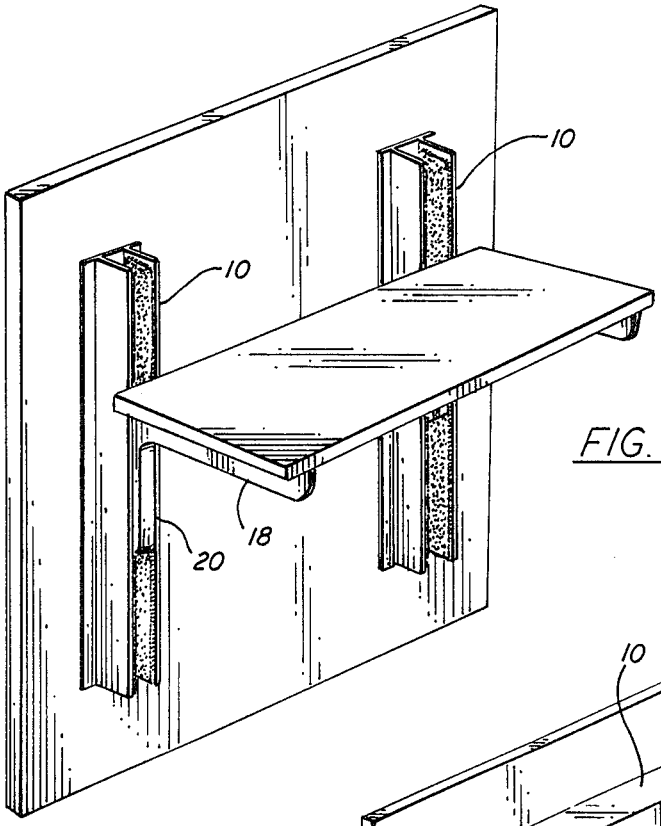
FIGS. 16–19 are perspective views of examples of applications of the present invention to provide a shelf support.
Figure 18:
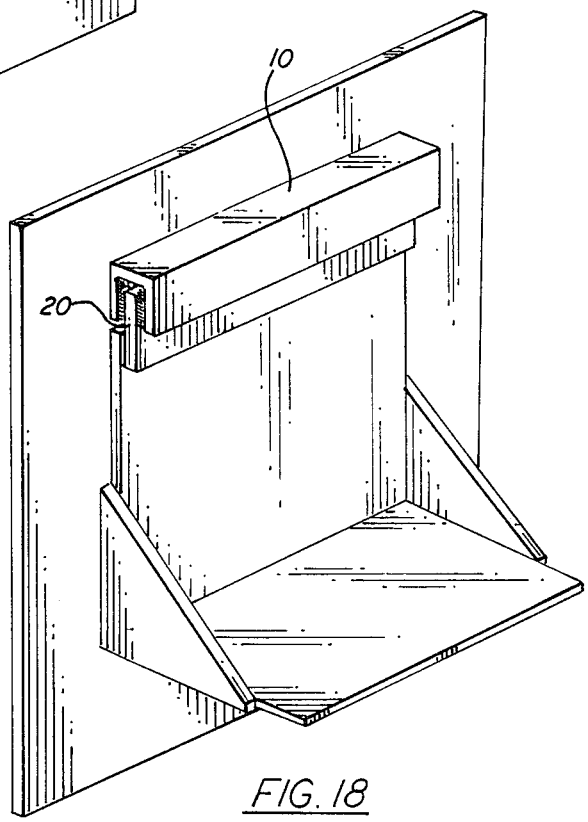
Figure 19:
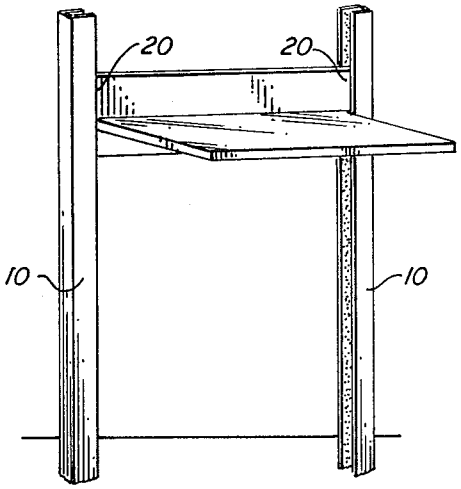
Figure 21:
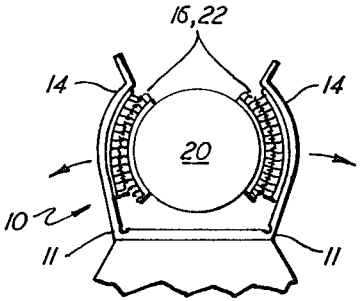
FIGS. 20 and 21 illustrate exemplary alternative cross-sections for the channel of FIGS. 1 and 2 with FIG. 20 showing the channel formed to engage a triangle cross-section member and FIG. 21 showing the channel with curved sides to engage a circular cross-section member, the reference numerals used are consistent with those in FIGS. 1 and 2.
Figure 17:
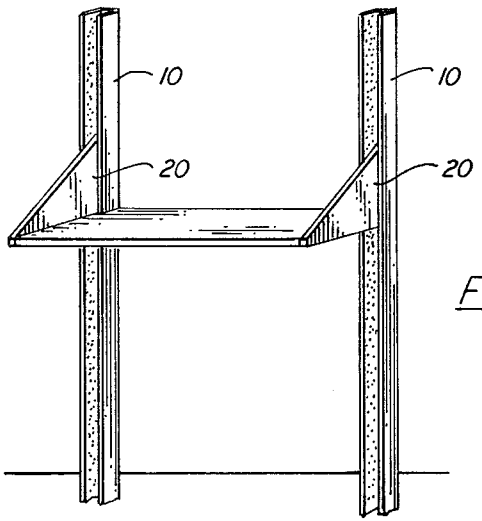
Figure 20:
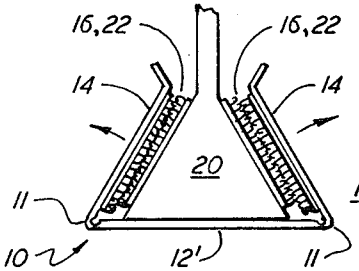

By way of further illustration FIG. 16 illustrates a shelf supported on two brackets (as described with reference to FIG. 3) mounted with their fins 20 engaged in shear by means of hook and loop material within two vertically mounted shear trap channels as shown in FIG. 1. FIG. 17 shows a variation of the support structure of FIG. 16 in which the brackets are integrally formed with the shelf with fin portions 20 mounted by hook and loop material in shear to shear trap channels. FIG. 18 illustrates a shelf supported by horizontal fin 20 within a horizontally disposed shear trap channel 10 such as is illustrated in FIG. 2 the engagement again being by hook and loop material in shear. FIG. 19 utilizes two shear trap channels of the type illustrated in FIG. 2 but with the channels mounted vertically inwardly facing toward one another and with the fins 20 being on opposite ends of a mounting plate engaged within the channels by hook and loop material in shear and with the supported shelf originally attached to that plate. In all these embodiments the component, for example, the shelf may be progressively released from its shear engagement by means of hook and loop material by hinging a side 14 of the channel relative to the back 12.

Thus, it can be seen that the present invention has met its objective by providing two entire families of components, including shelf brackets, that can be manufactured of economic and lightweight plastic, and the like, which provide for high stress and force resistant holding power while, at the same time, are easy to configure and reconfigure as the need dictates.

A touch fastener, as used in this application, comprises a first planar backing material having a surface carrying hooks, mushrooms, balls on stems, pigtails, or the like, capable of engaging loops, hooks, mushrooms, balls on steams, pigtails, or the like, carried by a second planar backing material to releasably fasten components together. Terms herein referring to hook and loop fastening systems and parts thereof shall be construed to include other types of touch fasteners in which the fastening strength in shear (i.e. against forces applied in the plane of the fastener) substantially exceeds the fastening strength resisting peeling separation of the fastener by the application of force normal to the plane thereof.

Wherefore, having thus described my invention, I claim:

1. A wall hanging system for releasably fastening support means such as shelves and other like components to a wall or the like comprising two mating touch fastener portions, a hinged shear trap channel member and a substantially planar rigid unitary fin member;

(a) one of said touch fastener portions carrying engaging elements capable of releasably engaging elements carried by the other of said touch fastener portions;

(b) said hinged shear trap channel member having a resiliently rigid back portion interconnecting a pair of resiliently rigid opposed side portions, defining inwardly facing surfaces, with one of said touch fastener portions on each inwardly facing surface, said hinged shear trap channel member having at least one of its side portions connected to said back portion by hinge means;

(c) said substantially planar rigid unitary fin member defining opposed outwardly facing surfaces and having the other of said touch fastener portions on its opposed outwardly facing surfaces, whereby said hinged shear trap channel member releasably receives said rigid unitary fin member between its inwardly facing surfaces with the two touch fastener portions engaged to act in shear to connect said fin member and said shear trap channel member together, said rigid back portion being of a width such that the inwardly and outwardly facing surfaces are all substantially parallel to one another during said engagement, and said at least one hinged side portion being pivotable by said hinge means away from said fin member to provide progressive disengagement of the touch fastener portions when desired; and (d) said hinged shear trap channel member carrying a wall-mounting means on either of said back or side portions securing one of said back or side portions to a wall, and the support means carrying attachment means, including the other of said members, for releasable engagement with said one of said members.

2. The wall hanging system of claim 1 wherein the engaging elements of said one of said touch fastener portions are one of hooks, loops, mushrooms, balls on stems, pigtails and the like and the engaging elements of said other of said touch fastener portions are one of hooks, loops, mushrooms, balls on stems, pigtails and the like.

3. The wall hanging system of claim 2, wherein said mounting means comprises a plurality of holes in said back portion for receiving mounting devices such as screws, nails, and bolts therethrough.

4. The wall hanging system of claim 2 wherein said mounting means comprises a plurality of holes in at least one side portion for receiving mounting devices such as screws, nails, and bolts therethrough.

5. The wall hanging system of claim 2 wherein said shear trap channel member is disposed horizontally.

6. The wall hanging system of claim 2 wherein said shear trap channel member is disposed vertically.

7. The wall hanging system of claim 2 wherein said support means is connected to said rigid unitary fin member.

8. The wall hanging system of claim 2 wherein said support means is integrally formed with said rigid unitary fin member.

9. The wall hanging system of claim 5 wherein:

said attachment means comprises a fin member in the form of a vertical fin extending upward substantially parallel to the back surface of said support means at a point of intended mounting to a said horizontally disposed shear trap channel member.

10. The wall hanging system of claim 6 wherein:

said attachment means comprises a fin member in the form of a vertical fin extending outward substantially perpendicular to the back surface of said support means at a point of intended mounting to a said vertically disposed shear trap channel member.

11. The wall hanging system of claim 2 wherein:

said support means is a planar shelf bracket and said vertical fin comprises an outward extension in the plane of said shelf bracket.

12. The wall hanging system of claim 10 wherein said support means carries on its front surface at least one of a coat hanger, a ring, a hook, a waste recepticle, a file holder and a nest of small containers.

13. The wall hanging system of claim 11, wherein said support means carries on its front surface at least one of a coat hanger, a ring, a hook, a waste recepticle, a file holder and a nest of small containers.

14. The wall hanging system of claim 4 wherein two of said shear trap channel members are mounted vertically and face inwardly toward one another, said support means carrying two fin members on its back surface, each said fin member being on opposite ends of the back surface and lying substantially in a plane, wherein each fin member being capable of engaging with one of said two inwardly facing shear trap channel members to support said support means to said shear trap channel members.

* * * * *